US007557518B2

(12) United States Patent
Zagar et al.

(10) Patent No.: US 7,557,518 B2
(45) Date of Patent: Jul. 7, 2009

(54) SOLID-STATE, COLOR-BALANCED BACKLIGHT WITH WIDE ILLUMINATION RANGE

(75) Inventors: Peter A. Zagar, Hartford, WI (US); Frederick C. Ellner, Glendale, WI (US); Hans C. Hansen, West Bend, WI (US)

(73) Assignee: Astronautics Corporation of America, Milwaukee, WI (US)

( * ) Notice: Subject to any disclaimer, the term of this patent is extended or adjusted under 35 U.S.C. 154(b) by 325 days.

(21) Appl. No.: 11/338,315

(22) Filed: Jan. 24, 2006

(65) Prior Publication Data

US 2007/0171670 A1 Jul. 26, 2007

(51) Int. Cl.
*H05B 41/38* (2006.01)

(52) U.S. Cl. ..... 315/291; 315/307; 345/83; 345/102

(58) Field of Classification Search ..... 315/169.3, 315/291, 292, 307, 362, 308, 224; 345/211, 345/102, 82, 87–90, 83
See application file for complete search history.

(56) References Cited

U.S. PATENT DOCUMENTS 5,107,184 A 4/1992 Hu et al.
5,406,305 A 4/1995 Shimomura et al.
5,933,089 A 8/1999 Katada
6,144,359 A 11/2000 Grave
6,281,640 B1 8/2001 Kim
6,388,388 B1 5/2002 Weindorf et al.
6,452,582 B1 9/2002 Rolston
6,817,735 B2 11/2004 Shimizu
6,841,947 B2 1/2005 Berg-johansen
6,975,079 B2 * 12/2005 Lys et al. ..... 315/292
7,002,546 B1 * 2/2006 Stuppi et al. ..... 345/102
7,173,384 B2 * 2/2007 Plotz et al. ..... 315/291
2001/0035848 A1 11/2001 Johnson et al.
2002/0130786 A1 9/2002 Weindorf
2003/0169226 A1 9/2003 Yamada
2003/0214242 A1 11/2003 Berg-johansen
2004/0109244 A1 6/2004 Kokogawa
2005/0068270 A1 * 3/2005 Awakura et al. ..... 345/76
2005/0093792 A1 5/2005 Yamamoto et al.
2005/0116921 A1 6/2005 Kim
2006/0006821 A1 * 1/2006 Singer et al. ..... 315/312

OTHER PUBLICATIONS

Author: Richard Borkowski, "Modifying Your Cockpit Lighting for Night Vision," in the Journal of the Airborne Law Enforcement Association, Mar.-Apr. 2005.

* cited by examiner

*Primary Examiner*—Douglas W Owens
*Assistant Examiner*—Ephrem Alemu
(74) *Attorney, Agent, or Firm*—Boyle Fredrickson, S.C.

(57) ABSTRACT

A color balanced solid-state backlight provides feedback control of each color using a single photodetector by imposing a modulation pattern on the solid-state lamps revealing individual colors to the photodetector. The photodetector signal provides feedback controlling color balance over a small range of instantaneous brightness less than larger range of average brightness of the display to provide for accurate color balance throughout a large range of average brightnesses.

20 Claims, 5 Drawing Sheets

SOLID-STATE, COLOR-BALANCED BACKLIGHT WITH WIDE ILLUMINATION RANGE

CROSS-REFERENCE TO RELATED APPLICATIONS

--

STATEMENT REGARDING FEDERALLY SPONSORED RESEARCH OR DEVELOPMENT

--

BACKGROUND OF THE INVENTION

The present invention relates to backlights for instruments such as those using liquid crystal displays and, in particular, to a backlight suitable for avionics and providing a wide range of brightness in a color-balanced white output formed from the combination of light from multiple colored sources.

Graphic displays, such as those employing a liquid crystal display ("LCD") screen provide a field of pixel elements each of which may be independently controlled to block or pass light, for example, from an underlying backlight.

A common backlight for use with an LCD screen provides a transparent panel edge-lit or backlit by one or more fluorescent tubes. In the edge-lit design, a reflective rear surface of the panel directs the edge illumination towards an LCD screen positioned against a front surface of the panel. The reflective rear surface of the panel may be gradated to produce an even field illumination behind the LCD compensating for an inherent falloff of brightness with distance of the fluorescent tube.

Fluorescent tubes provide a relatively high efficiency light source providing a broad color spectrum output suitable for backlighting color LCD screens in which pixels associated with red, green, and blue light components must be evenly illuminated for good color rendition.

When backlit LCD screens are used in avionics applications, a wide range of illumination output is desirable to allow the avionics display to be easily readable, both in bright sunlight and in levels of very low light and over a wide range of ambient temperatures. In low light situations, too much illumination can interfere with dark adaptation and night vision goggles or similar equipment.

Fluorescent tubes have a number of disadvantages in avionics applications including: the need for a high voltage power supply, a fragility of the glass tube, a tendency to fail unexpectedly, low efficiency at low ambient temperatures, and a limited ability to change brightness level. For these reasons, it is known to use light-emitting diodes ("LEDs") as a replacement for fluorescent tubes, particularly in avionics and other demanding applications. In order to provide a multi-spectral output needed for color LCD screens, such LED backlights provide clusters of red, blue, and green LEDs. Preferably, each color of LED may be separately controlled in brightness. When these different colors of LEDs are energized together with the correct relative brightness, they produce a light that appears substantially white to the human eye.

The relative brightness of each of the LEDs must normally be adjusted electronically to obtain the correct color balance to provide white light. Maintaining this color balance as the backlight is varied in brightness, can be difficult because of different and often non-linear relationships between light output and current for each of the different colors of LEDs.

That is, over a given range, a uniform change in current provided to the LEDs for each color will tend to cause a color shifting of the backlight. The function relating brightness to current can change with the temperature and age of the LED further complicating attempts to maintain color balance over a wide range of illumination.

SUMMARY OF THE INVENTION

The present invention provides a color-balanced LED backlight that maintains color balance over a wide range of illumination by means of a set of feedback loops, one for each color. Sensing the light output for each feedback loop requires only a single photodetector which distinguishes among colors by a "measurement modulation" of the LEDs during a first period of time, to reveal each color in isolation. For example, during this first period of time, the LED's of only one color will be energized at a time. Brightnesses of each color determined during the measurement modulation are held and used after the measurement modulation to control the LEDs when the LEDs are energized simultaneously during a second period of time.

This brief measurement modulation period eliminates the need for color filters on multiple photodetectors that may age or degrade, or the need to balance the signals from multiple photodetectors, or correct for variations in those signals caused by age and temperature of different photodetectors. The feedback control of the LEDs may be combined with open loop pulse width modulation of the LEDs to permit an extremely wide range of illumination while retaining precise color balance enforced by the much narrower range of feedback color control. A narrower range of feedback allows use of a photodetector that has a narrower range but greater precision.

Specifically then, the present invention provides a backlight having a set of groups of solid state lamps, the lamps of each group providing a different color of light. A photodetector is positioned to receive light from all the groups to produce a measurement signal, and a modulator communicating with each group modulates the brightness of light from each group during a first period when the groups are jointly energized to provide a multi-spectral backlight of predetermined color and brightness, and a second period wherein the groups are independently excited to provide measurement signals revealing relative brightness of each color.

Thus it is an object of at least one embodiment of the invention to provide for measurement of the light from each color group without the need for isolating filters or multiple photodetectors associated with each color. By using modulation of the light sources to isolate the colors, a single photodetector may be used simplifying the design and preventing the need to calibrate or compensate among multiple detectors and further eliminating the cost and expense of filters and their possible degradation with time and temperature.

The first period may be greater than nine times longer than the second period.

Thus it is an object of at least one embodiment of the invention to provide a modulation that reveals the light output for each separate color group and yet does not significantly affect the total output of the backlight, for example, if each color were energized for one-third of the total time.

During the second period, the lamps of each group may be sequentially energized while lamps of the remaining groups are not energized.

Thus it is an object of at least one embodiment of the invention to provide for an extremely simple measurement of the light output of each lamp group.

Alternatively, multiple groups of lamps may be energized simultaneously during the second period.

Thus it is an object of at least one embodiment of the invention to provide an alternative embodiment in which isolated intensities for the color groups may be algebraically extracted.

The invention may include a sample circuit sampling the measurement signal at a subset of time of sequential illumination of each lamp during the second period.

Thus it is an object of at least one embodiment of the invention to minimize the length of the second period by short modulation pulses while eliminating artifacts measurement signal rise and fall times.

The invention may include feedback circuitry controlling the modulator according to the relative intensities of the colors determined during the second period to provide a predetermined color.

Thus it is an object of at least one embodiment of the invention to provide for ongoing color correction of the backlight.

Feedback circuitry may provide separate feedback loops for each group.

Thus it is an object of at least one embodiment of the invention to allow for color correction that accommodates variations in characteristics of LEDs of different colors.

The circuit may include a memory circuit, for example, a sample and hold, storing the relative intensities of the groups for use during the first period.

Thus it is an object of at least one embodiment of the invention to separate the time of measurement of color balance from the time of illumination to prevent interference in the color measurement from changes in the total brightness of the backlight.

The system may include a controller providing the modulator with a joint modulation signal for controlling brightness and color-specific modulation signals for controlling color.

Thus it is an object of at least one embodiment of the invention to provide independent control of color balance over a wide range of brightness.

The modulator may provide a duty cycle modulation of the lamps according to the first signal and a current control of the lamps according to a second signal.

It is thus another object of at least one embodiment of the invention to require only limited feedback range in color control (determined by the pulse heights) over a much wider range of brightness control (determined by the pulse heights and widths).

The controller may employ a duty cycle control of the lamps during a first range of brightness and current control of the lamps during a second range of brightness less bright than the first range of brightness.

It is another object of at least one embodiment of the invention to preserve a measurement modulation period by limiting duty cycle modulation for low levels of brightness.

These particular objects and advantages may apply to only some embodiments falling within the claims and thus do not define the scope of the invention.

DETAILED DESCRIPTION OF THE PREFERRED EMBODIMENT

Figure 1:
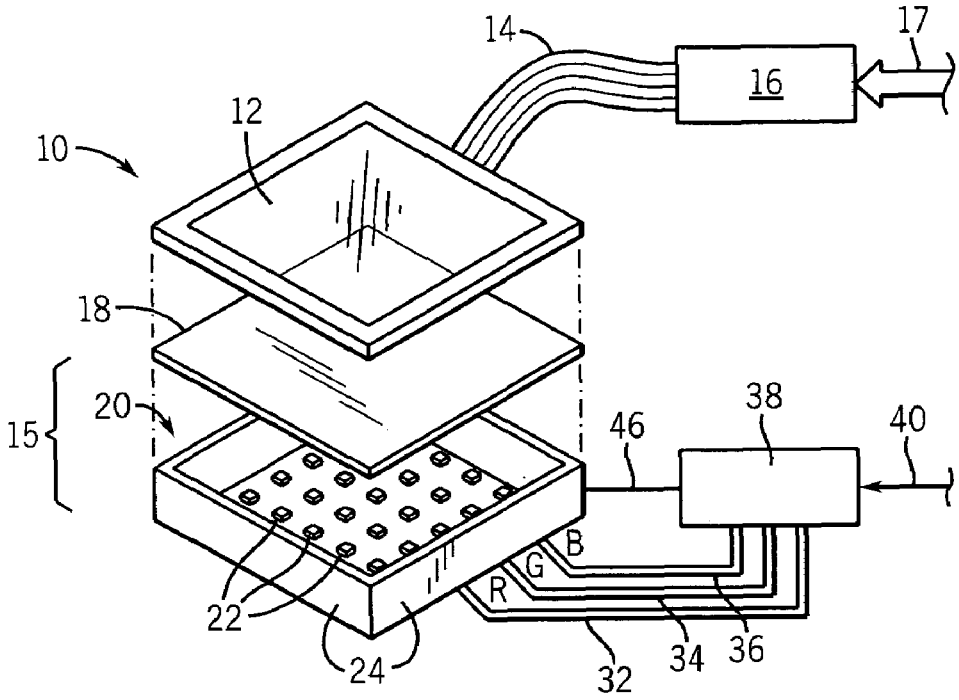
FIG. 1 is an exploded perspective view of an LCD screen and backlight of the present invention employing an LED matrix and a controller receiving a brightness signal.

Referring now to FIG. 1, an avionics display 10 may, for example, include a transmissive liquid crystal display ("LCD") 12 attached by a cable 14 to avionics electronics 16. Avionics electronics 16 may, for example, provide signals to the avionics display 10 producing graphic representations of indicator gauges and the like based on data 17 received from sensors in the aircraft.

The LCD screen 12 provides a plurality of electronically controllable pixels for each of three colors: red, green and blue, to provide for a color display when backlit by a multi-spectral and preferably white or nearly white light.

Positioned behind the LCD screen 12 may be a backlight 15 comprised of a diffuser 18 and an LED array 20. The diffuser 18 positioned between the LED array 20 and the LCD screen 12 serves to spread the light from many point source LEDs in the LED array 20. The diffuser 18, may, for example, also include a lens or holographic screen that collimates or directs the light toward a preferential viewing angle.

Figure 2:
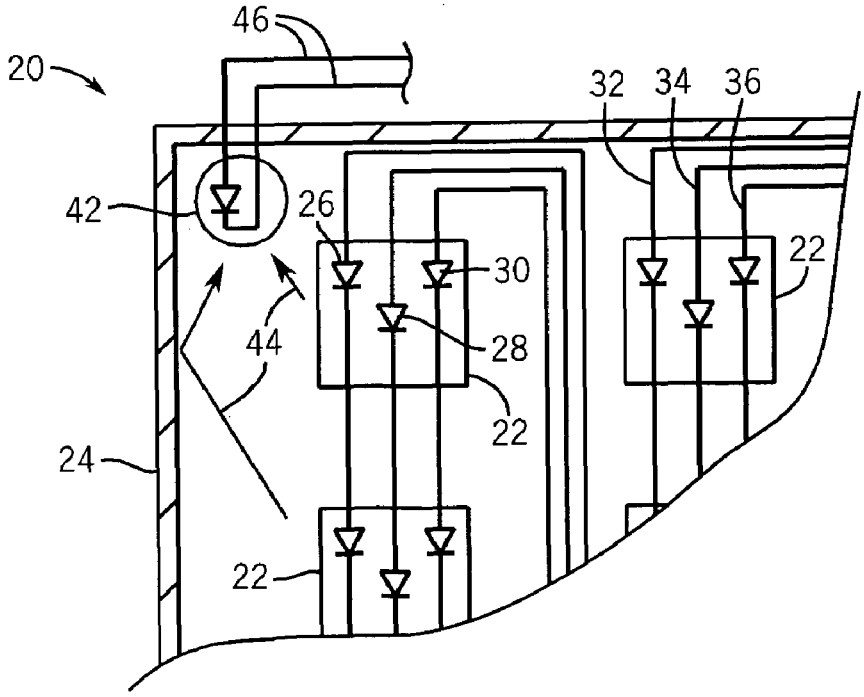
FIG. 2 is a fragmentary, plan/schematic view of the LED matrix showing positioning of red, green, and blue light emitting diodes with respect to an integrated photodetector.

Referring also to FIG. 2, the LED array 20 holds a set of multi-LED units 22 arranged, for example, on a regular grid over a mirrored planar surface commensurate with the area of the LCD screen 12. Upstanding mirrored side walls 24 around the grid of multi-LED units 22 provide an enclosure open toward the diffuser 18 that serves to spread light from the multi-LED units 22 uniformly within the enclosure to provide a more even field of illumination.

Each of multi-LED units 22 may include red, green, and blue LEDs 26, 28 and 30, respectively. Matching colors of the red, green and blue LEDs 26, 28 and 30 are grouped together and wired commonly, either in series or preferably in parallel to be controllable as independent groups of a single color. Thus, for example, red LEDs 26 of each of the multi-LED units 22 are wired to a red control line 32 (providing two conductors for power and a return) to be controlled as a group. Similarly, green LEDs 28 of each of the multi-LED units 22 are connected to be controlled by green control line 34, and blue LEDs 30 of each of the multi-LED units 22 are connected to be controlled by blue control line 36, each to be controllable as a group independently of the other groups. Each of the control lines 32, 34 and 36 are received by a controller 38 that also receives a brightness signal 40 and providing electrical signals on control lines 32, 34 and 36 to control the brightness and color of the backlight 15 formed of diffuser 18 and LED array 20.

Referring to FIG. 2, a photodetector 42, for example, a photodiode, may be positioned within the reflective chamber formed by upstanding reflective and preferably mirrored sidewalls 24 to receive light 44 from multiple ones of the multi-LED units 22. The photodetector 42 is attached to lead lines 46 to provide a measurement signal indicating the brightness of the light within the enclosure as contributed from many ones of the multi-LED units 22. The photodetector 42 is generally multi-spectral sensitive to each different color of light from LEDs 26, 28 and 30 to provide the electrical signal proportional thereto.

Figure 3:
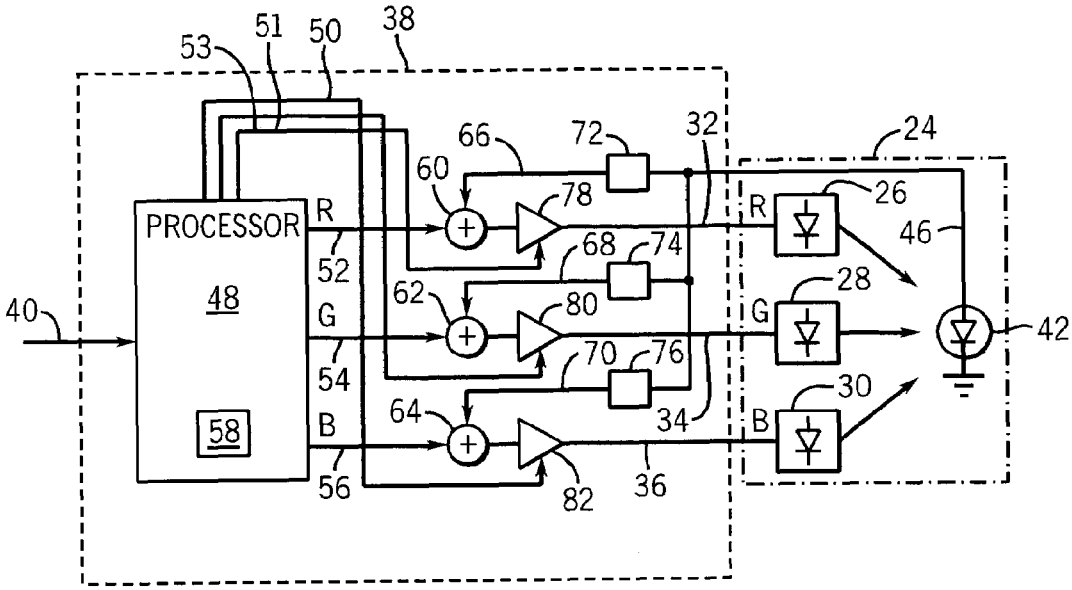
FIG. 3 is a block diagram of the controller of FIG. 1 showing a processor in the controller such as provides first analog modulation signals for red, green and blue current control and second binary red green and blue modulation signals, and showing local feedback loops responding to only the analog modulation signals.

Referring to FIG. 3, the controller 38 may generally employ a processor 48 being in the preferred embodiment, a micro controller executing a stored program but also possibly being discrete circuitry or a programmable gate array. The processor 48 receives the brightness signal 40 and provides for two distinct sets of modulation signals. The first set is red, green and blue binary control signals 50, 51 and 53 providing, during a first period, a binary signal having a varying on time proportional to a desired brightness of the backlight 15, and during a second period a measurement modulation to be described. The second set of modulation signals is red, green, and blue analog control signals 52, 54 and 56 providing an analog or continuous signal indicating a desired relative brightness of each of the LEDs 26, 28 and 30.

Generally, as will be described, the processor sets the initial relative values of the analog red, green, and blue analog control signals 52, 54 and 56 according to a desired color balance stored in memory 58, in the processor 48 or hard-wired into its circuitry through potentiometers and the like. When the brightness signal has a high value, indicating the backlight 15 should have a high light output, the values of the analog red, green, and blue analog control signals 52, 54 and 56 remain essentially constant and brightness is varied by changing the on-time of the red, green and blue binary control signals 50, 51 and 53. For low light levels, the red, green, and blue analog control signals 52, 54 and 56 are changed by equal percentage adjustments to provide for extremely low light control.

Referring still to FIG. 3, each of the red, green, and blue analog control signals 52, 54 and 56 provides a command input to a corresponding summing junction 60, 62 and 64, the summing junctions implementing separate feedback loops for each color and producing error signals when red, green, and blue analog control signals 52, 54 and 56 are compared to sampled feedback signals 66, 68 and 70. The sampled feedback signals 66, 68 and 70 are received from corresponding sample-and-hold circuits 72, 74 and 76, respectively, which in turn receive the output of the photodetector 42 to sample its light output signal as will be described below.

The error signal from the summing junction 60, 62 and 64 is received by gating current amplifiers 78, 80 and 82 which also receive the red, green and blue duty cycle binary control signals 50, 51 and 53, the latter which gate the gating current amplifiers 78, 80 and 82 to block or pass the brightness signal to control lines 32, 34 and 36 ultimately to the groups of LEDs 26, 28 and 30.

Generally, the feedback loops formed as described above serve to provide a regulated output for the groups of LEDs 26, 28 and 30 that is indifferent to aging, temperature effects, and nonlinearities intrinsic to the LEDs 26, 28 and 30. Note that the sampled feedback signals 66, 68 and 70 from the photodetector 42 are used only in the local feedback loops and are not provided to the processor 48 or used by the processor 48 to modify the binary control signals 50, 51 and 53 or the analog red, green, and blue analog control signals 52, 54 and 56. This is true even though the brightness of a given group of LEDs 26, 28 and 30 will be dependent, both on the red, green and blue duty cycle binary control signals 50, 51 and 53 and the error voltage from the summing junctions 60, 62 and 64 as possibly amplified by a constant amount by gating current amplifiers 78, 80 and 82.

Figure 4:
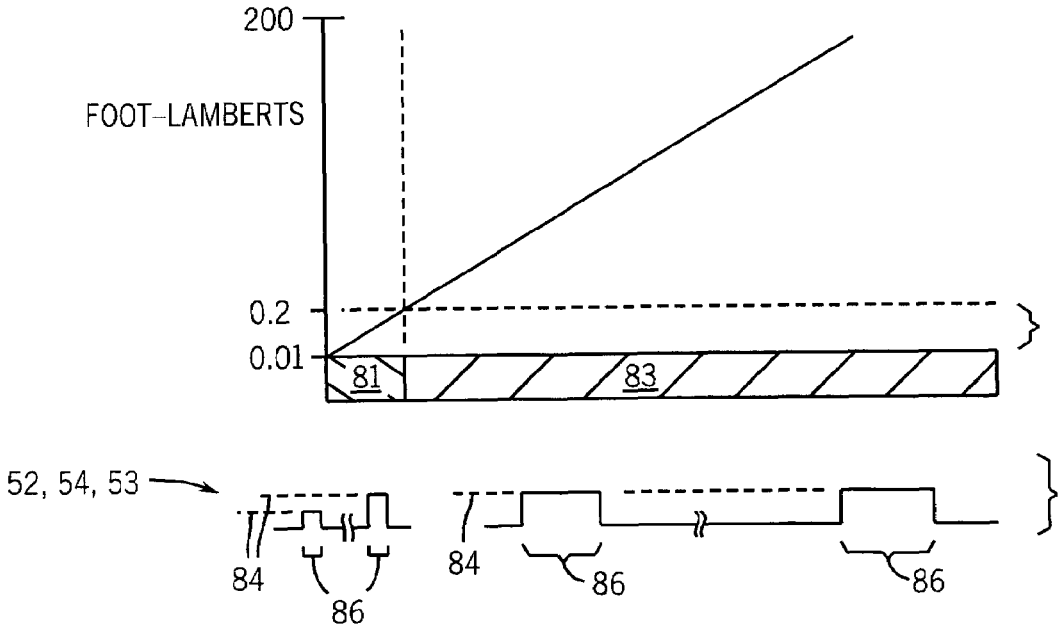
FIG. 4 is a chart showing the two control regimes implemented by the processor of FIG. 3 providing current control for low light outputs and duty cycle modulation for high light outputs.

Referring now to FIG. 4, the brightness of the backlight 15 may vary over a range of 20,000:1, in a preferred embodiment, from approximately 0.01 foot-lamberts to 200 foot-lamberts. The processor 48 provides for this range of operation by using one of two modulation regimes 81 and 83 depending on the brightness signal 40. The boundary between modulation regimes 81 and 83 can be varied but in a preferred embodiment, for range of 0.01 to 0.2 foot-lamberts, variations in brightness are obtained in the first low-light regime 81 by uniformly scaling the amplitude 84 of the red, green, and blue analog control signals 52, 54 and 56 (holding a constant pulse width 86, e.g. zero). Thus, different values of the red, green, and blue analog control signals 52, 54 and 56, as set for a desired color balance, are multiplied by a common scaling factor. Nonlinearities that differ among the LEDs 26, 28 and 30 and that may cause a slight shifting of color balance in this low-light regime 81 are controlled by feedback.

When the brightness signal 40 commands a brightness above 0.2 foot-lamberts, in the second bright-light regime 83, the red, green, and blue analog control signals 52, 54 and 56 are held constant in amplitude 84 and the red, green and blue duty cycle binary control signals 50, 51 and 53 are used to vary the pulse widths 86 in duty cycle, pulse width, or pulse density-type modulation.

Figure 5:
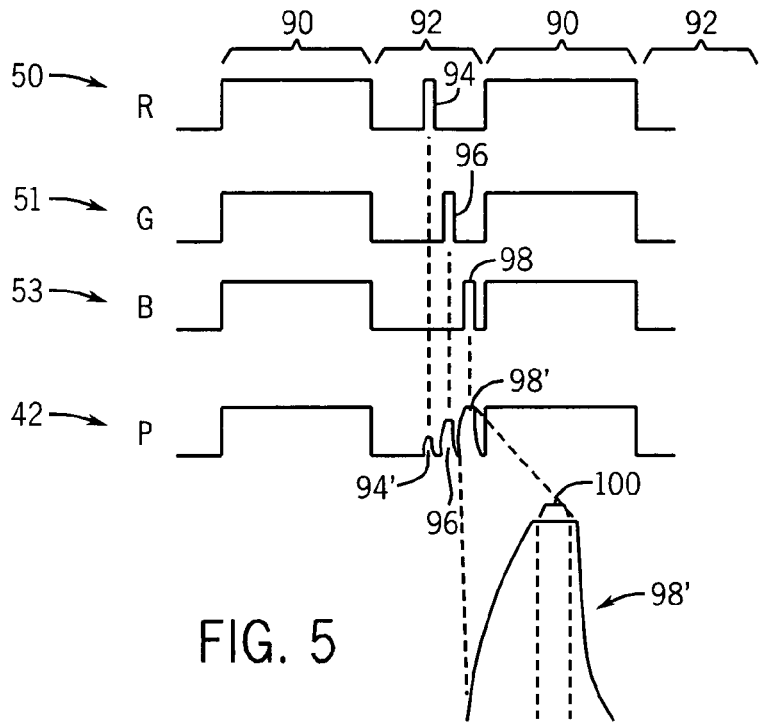
FIG. 5 is a timing diagram showing the activation of the red, green and blue LEDs during a measurement modulation period and showing a composite received signal from the photodetector with an enlarged inset showing a sample point for one color of the received signal from the photodetector.

Referring now to FIGS. 3 and 5, in order to provide for independent feedback loops for each of the groups of LEDs 26, 28 and 30, the signal on lines 46 from photodetector 42 must be processed to provide separate measurements of the brightness of each group of LEDs 26, 28 and 30. Thus, feedback control of the group of red LEDs 26 requires a measurement of red light isolated from green and blue light, and similarly the feedback control of the groups of green LEDs 28 requires a measurement of green light isolated from red and blue light, and feedback control of the groups of blue LEDs 30 requires a measurement of blue light isolated from green and red light.

In the preferred embodiment, this decomposition of the measurement signal from the photodetector 42 into separate color measurements is done by using the red, green and blue duty cycle binary control signals 50, 51 and 53 to provide a separate brightness modulation period 90 and a measurement modulation period 92. During brightness modulation period 90, each of the binary control signals 50, 51 and 53 provide identical duty cycle modulation of the group of LEDs 26, 28 and 30 varying an on-time proportion in proportion to the brightness signal 40 to control the average illumination of the backlight 15.

In contrast during measurement modulation period 92, no duty cycle modulation is provided, but in sequence, light from all of the groups of LEDs 26, 28 and 30, but one, are suppressed. Thus, during measurement modulation period 92, first, the group of red LEDs 26 only is activated for a short pulse 94 using binary control signal 50. Next, a short pulse 96 of binary control signal 51 activates only the green LEDs 28, and then a pulse 98 of binary control signal 53 activates only the blue LEDs 30.

The photodetector 42 thus provides three corresponding pulses 94', 96' and 98' during measurement modulation period 92, each pulse 94', 96' and 98' being proportional in height to the light output of a single group and thus a single color of LEDs 26, 28 and 30, respectively. The processor 48 provides capture signals (not shown) to sample-and-hold circuits 72, 74 and 76, respectively, to sample each of the pulses 94, 96 and 98 to provide the sampled feedback signals 66, 68 and 70, respectively. The sampling occurs during sample intervals 100 centered within the pulse's 94', 96' and 98' so as to eliminate the effect of rise time and decay time on the measurement.

Referring now to FIGS. 4 and 5, because the signals to the LEDs 26, 28 and 30 on control lines 32, 34 and 36 vary in amplitude only during the low-light regime 81 and not during the bright-light regime 83, the dynamic range in brightness that must be accommodated by photodetector 42 is substantially limited. In this example, the photodetector 42 must only accommodate a 20 to 1 rather than 20,000 to 1 variation in instantaneous light output. This allows for an extremely precise relative brightness control of each of the groups of LEDs 26, 28 and 30 ensuring stable color control. Whereas, brightness variation in the backlight 15 on the order of 10 to 20 percent may be readily accommodated for total multi-spectral brightness, such a variation among each of the color components would result in undesirable color shifting. Accordingly, eliminating feedback control of the total dynamic range of brightness of 20,000 to 1 provides for improved color accuracy. The approach relaxes the requirements of the photodetector 42, allowing standard photodetectors 42 to be used with minor colors sensitivity variation being accommodated with calibration factors stored in memory 58 as described above.

Figure 6:
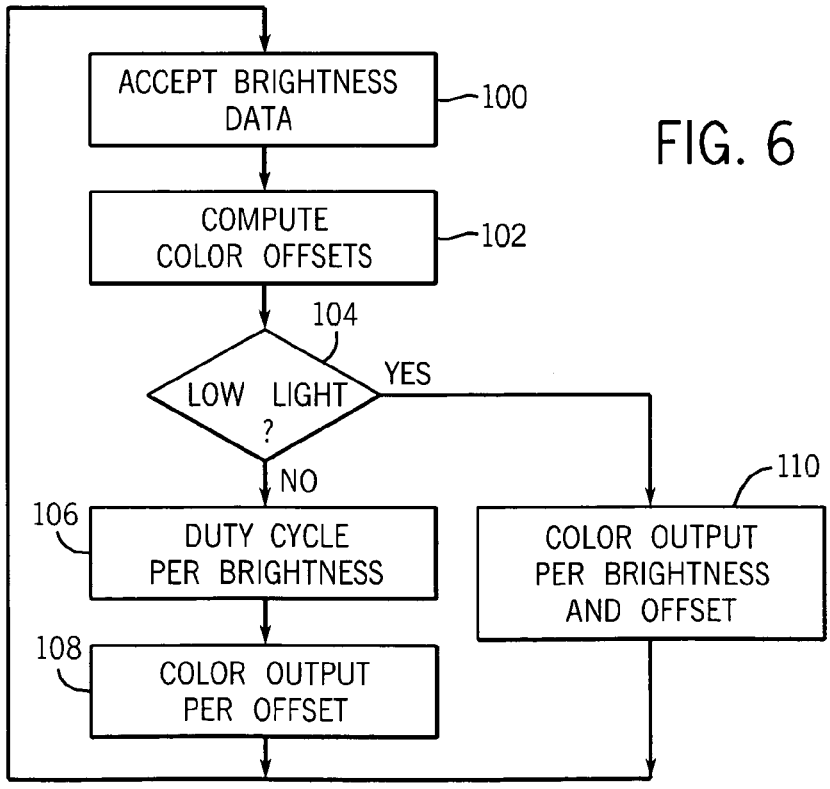
FIG. 6 is a flowchart showing operation of the processor in implementing the regimes of FIG. 4.

Referring now to FIG. 6, the processor 48 operates to accept brightness signal 40 as indicated by process block 101. The values of analog red, green, and blue analog control signals 52, 54 and 56 are set to provide the desired color balance as indicated by process block 102 as may be precomputed or preset at the factory to a constant value or, in an alternative embodiment, varied according to the brightness signal 40 to preserve a desired color balance.

At decision block 104, the processor 48 determines whether the brightness signal 40 is above or below the threshold level between control low-light regime 81 and bright-light regime 83 shown in FIG. 4. If a low light condition does not exist, then bright-light regime 83 is indicated, and as represented by process block 106, a duty cycle is calculated on an open loop basis to create the desired brightness of the backlight 15. Because the duty cycle modulation of bright-light regime 83 operates the LEDs 26, 28 and 30 at essentially constant current levels, non-linearities in the relationship between brightness and current may be largely ignored while providing this open loop control. Further, as indicated by process block 108, the relative brightness of each of the groups of LEDs 26, 28 and 30 during on times of the duty cycle is held fixed according to the ratios established at process block 102 as maintained by the feedback loops.

If at decision block 104, the low light regime 81 is indicated by the brightness signal 40, then the program branches to process block 110 to provide a scaling of the values for analog red, green, and blue analog control signals 52, 54 and 56 (from the values previously set per process block 102) reducing the command brightness values by equal percentages while preserving the offsets and thus the ratios between the brightness values represented by analog red, green, and blue analog control signals 52, 54 and 56. At this time, brightness modulation periods 90 may provide for a small or zero on-time of the LEDs 26, 28 and 30 and illumination provided by simply the sampling values of pulses 94, 96 and 98 shown in FIG. 5. In this case, the measurement modulation period 92 also provides for brightness modulation by current control.

Because a single photodetector 42 may be used in this application, balancing of light between photodetectors is not required and possible unequal aging, or temperature effects in the photodetectors are largely eliminated. Precise brightness feedback control is provided for color balance without the need for high compliance or operating range in the photodetector 42. The modulation performed during measurement modulation period 92 eliminates the need for separate photodetectors or filters or the attachment of individual photodetectors to individual LEDs to serve as a proxy for other devices. It will be recognized, however, that the benefits of limiting the range of feedback control to improve color balance compliance, may also benefit these other techniques that employ filters or multiple photodetectors.

Figure 7:
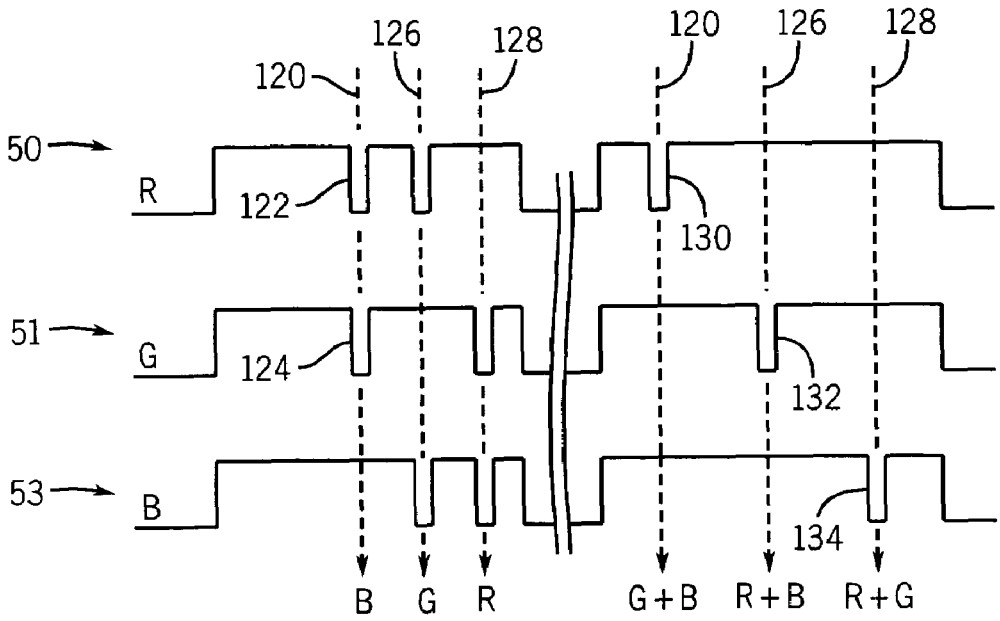
FIG. 7 is a set of timing diagrams providing alterative measurement modulation methods per the present invention.

Referring now to FIG. 7, the invention is not limited to the modulation shown in FIG. 5, but may be used with other modulation schemes so long as they provide the photodetector 42 or multiple ganged photodetectors to provide an independent measurement of the light intensities of each of the groups of LEDs 26, 28 and 30. Thus, as shown by the left half of the timing diagram of FIG. 7, the measurement modulation period 92 may be distributed among the brightness modulation periods 90 so that the two are merged with negative-going pulses serving to darken two of the colors from the groups of LEDs 26, 28 and 30 (for each of three combinations of the two colors) so as to unambiguously reveal the individual colors. Thus, at a first time 120, negative-going pulses 122 and 124 may be applied to the red and green duty cycle binary control signals 50 and 51 so as to effectively provide that during time 120 only a brightness of the blue LEDs 30 is measured. Likewise, at times 126 and 128, red and blue duty cycle binary control signals 50 and 53, and then green and blue duty cycle modulation signals 51 and 53 may be suppressed by corresponding negative-going pulses so that time 126 reveals the brightness of green LEDs 28 and time 128 reveals the brightness of red LEDs 26.

Alternatively, referring to the right side of FIG. 7, a single negative-going pulse for each of times 120, 126 and 128 may occur in each of the red, green and blue duty cycle binary control signals 50, 51 and 53, staggered in time. Thus, a negative-going pulse 130 at time 120 in red binary control signal 50 provides the photodetector 42 with a reading of the combined brightness of the green LEDs 28 and blue LEDs 30. A later negative-going pulse 132 at time 126 in signal 51 provides a reading of the combined brightness of the red LEDs 26 and blue LEDs 30, and a later negative-going pulse 134 at time 128 provides a reading of the combined brightness of the red LEDs 26 and green LEDs 28. A simple algebraic combination of these three values yields independent values for red, green and blue.

Referring again to FIG. 1, the LED array 20 of LEDs may alternatively employ an edge-lit light panel having a reflective rear surface or other method of producing uniform light fields using point sources well known in the art.

Figure 8:
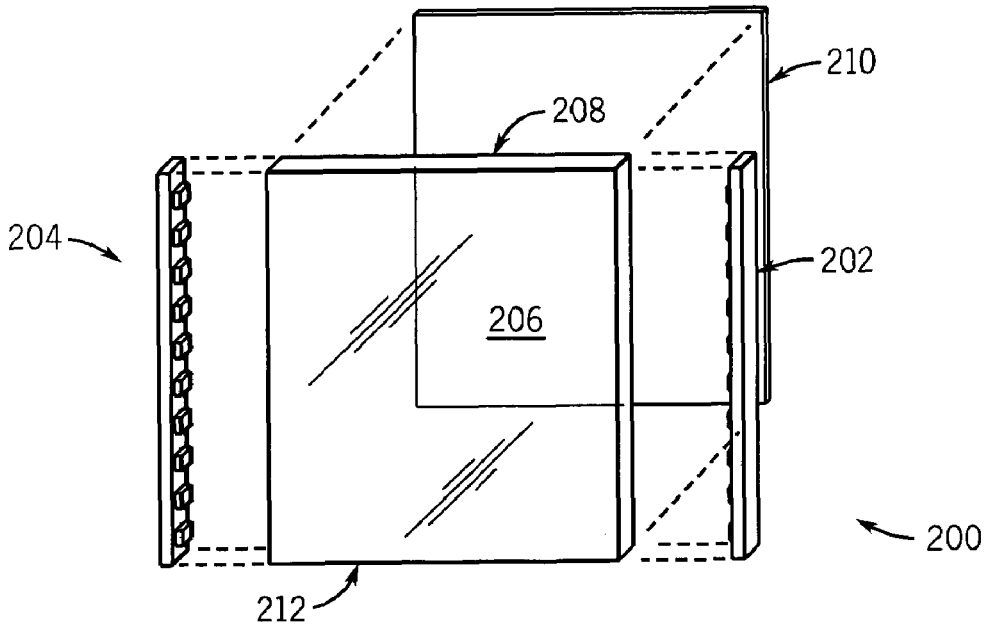
FIG. 8 is a perspective view of an alternative backlight embodiment using an edge-lit panel also suitable for the present invention.

Referring now to FIG. 8, an alternative embodiment of a LCD backlighting system includes an edge-lit backlight system 200. The edge-lit backlight system 200 includes first and second LED assemblies 202, 204 arranged opposite one another and separated by a clear light guide panel 206. Engaged with a back 208 of the light guide panel 206 is a reflector film backing 210 configured to reflect light injected by the LED assemblies 202, 204 into the guide panel 206 toward a front 212 of the guide panel 206.

Figure 9:
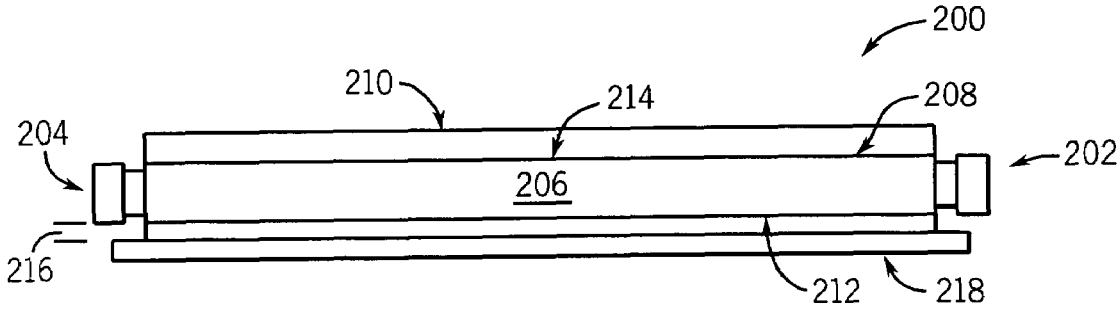
FIG. 9 is a side view of the panel of FIG. 8.

This arrangement is further illustrated in FIG. 9, where the reflecting film 210 is arranged against the back 208 of the light guide panel 206. Also arranged at the back 208 of the light guide panel 206 may be a diffusing layer 214 that may be disposed between the reflecting film 210 and the guide panel 206 to diffuse light directed from the light guide panel 206 toward the reflecting film 210 and light directed back from the reflecting film 210 toward the front 212 of the light guide panel 206. Additionally, it is contemplated that one or more brightness enhancing and/or light directing films 216 may be arranged in front of the light guide panel 206. Finally, an LCD panel 218 is arranged forwardly of the edge-it backlight system 200 to receive light generated by the LED assemblies 202, 204. The photodetector 42 (not shown) may also be placed at one edge of the light guide panel 206 to receive light from multiple ones of the LEDs of assemblies 202, 204, which may be controlled as described above.

It is specifically intended that the present invention not be limited to the embodiments and illustrations contained herein, but include modified forms of those embodiments including portions of the embodiments and combinations of elements of different embodiments as come within the scope of the following claims.

We claim:

1. A backlight system comprising:

a set of groups of solid-state lamps, the lamps of each group providing a different color of light;

a photodetector positioned to receive light from all of the groups to produce a measurement signal; and a modulator communicating with each group to modulate a brightness of light from each group during:

(i) a first period wherein the groups are jointly energized to provide a multispectral backlight source of predetermined color and brightness and (ii) a second period wherein the groups are independently modulated to provide measurement signals revealing relative intensities of each color;

wherein the modulator provides pulse-width control of the lamps during the first period using currents whose non-zero magnitudes are independently varied for each color as functions of the measurement signals obtained from the second period.

2. The backlight system of claim 1 wherein the first period is not less than nine times longer than the second period.

3. The backlight system of claim 1 wherein, during the second period, the lamps of each group are sequentially energized while lamps of remaining groups are not energized.

4. The backlight system of claim 1 wherein multiple groups of lamps are energized simultaneously during the second period.

5. The backlight system of claim 1 including a sample circuit sampling the measurement signal at a subset of a time during which the lamps are energized during the second period.

6. The backlight system of claim 1 wherein the modulator controls relative intensities of each color to provide the predetermined color during the first period.

7. The backlight system of claim 6 wherein the modulator provides feedback control of the groups using the measurement signal and provides separate feedback paths for each group.

8. The backlight system of claim 1 further including a memory circuit storing the measurement signal for each color acquired from the second period for use during the first period.

9. The backlight system of claim 1 further including a controller providing the modulator with a first and second modulation signal for controlling jointly the brightness of the lamps of the groups, wherein the first and second modulation signals are derived from a desired brightness signal independently of the measurement signal from the photodetector.

10. The backlight system of claim 9 further including at least one feedback circuit providing a third modulation signal for controlling independently the brightness of the lamps of the groups, wherein the third modulation signal is derived from the second modulation signal and the measurement signal from the photodetector.

11. The backlight system of claim 9 wherein the modulator provides duty cycle modulation of the lamps according to the first modulation signal and continuous current control of the lamps according to the second modulation signal.

12. The backlight system of claim 9 wherein the first modulation signal changes to control a brightness of the lamps during a high range of the desired brightness signal, and the second modulation signal changes to control the brightness of the lamps during a low range of the desired brightness signal.

13. The backlight system of claim 1 further including a light spreader providing light from multiple lamps of each group to the photodetector.

14. The backlight system of claim 1 wherein the predetermined color and brightness is white.

15. The backlight system of claim 1 further including a light diffuser positioned adjacent to the set of solid state lamps and an LCD screen placed on an opposite side of the light diffuser from the solid state lamps.

16. A backlight system comprising:

a set of groups of solid-state lamps, the lamps of each group providing a different color of light;

at least one photodetector positioned to receive light from the groups of solid state lamps to produce at least one measurement signal; and a modulator communicating with each group to modulate a brightness of light from each group during:

(i) an illumination period wherein the groups are controlled to provide a multispectral backlight source of predetermined color and brightness, wherein the brightness is controlled by pulse width modulation of the groups; and (ii) a measurement period separate from the illumination period wherein the groups are controlled to provide measurement signals revealing relative intensities of each color;

wherein the modulator controls the brightness of the groups by control of instantaneous maximum current to each lamp during the illumination period according to measurement signals made during the measurement period.

17. A backlight system comprising:

a set of groups of solid-state lamps, the lamps of each group providing a different color of light;

at least one photodetector positioned to receive light from the solid state lamps to produce at least one measurement signal; and a modulator communicating with each group to modulate a brightness of light from the groups to vary a backlight brightness throughout a range of brightness by:

(i) controlling a duty cycle of the solid state lamps according to a desired brightness signal without regard to measurement signals; and (ii) controlling current of the solid-state lamps by changing a non-zero level of current according to the measurement signals.

18. A high dynamic range solid state backlight comprising:

a set of groups of solid-state lamps, the lamps of each group providing a different color of light;

at least one photodetector positioned to receive light from all of the groups to produce a measurement signal; and a modulator communicating with each group to modulate a brightness of light from the groups to vary a backlight brightness throughout a range of brightness using:

(i) duty cycle modulate the solid state lamps during a first range of brightness without reference to the measurement signal;

(ii) current modulate of the solid state lamps by continuously varying the current to the solid state lamps to control their brightness during a second range of brightness that is less than the first range; and (iii) further control the current modulation with feedback control using the measurement signal.

19. The high dynamic range solid-state backlight of claim 18 comprising: wherein the first range of brightness is in excess of 1000:1 and the second range of brightness is less than 1000:1.

20. The high dynamic range solid-state backlight of claim 18 comprising: wherein the first range of brightness and second range of brightness are divided at a brightness level of less than one foot-lambert.

* * * * *